US006513847B2

(12) United States Patent
Harris et al.

(10) Patent No.: US 6,513,847 B2
(45) Date of Patent: Feb. 4, 2003

(54) SIMPLE MULTIPLE CONCRETE BLOCK LIFTING DEVICE

(76) Inventors: Loren Harris, 17311 157th Ave. SE., Snohomish, WA (US) 98290; David Harris, 12327 Roosevelt Rd., Snohomish, WA (US) 98290; Brett Harris, 16301 107th Ave. NE., Bothell, WA (US) 98011

( * ) Notice: Subject to any disclaimer, the term of this patent is extended or adjusted under 35 U.S.C. 154(b) by 0 days.

(21) Appl. No.: 10/052,935

(22) Filed: Nov. 10, 2001

(65) Prior Publication Data

US 2002/0158478 A1 Oct. 31, 2002

Related U.S. Application Data

(60) Provisional application No. 60/287,142, filed on Apr. 27, 2001.

(51) Int. Cl.[7] ..... B66C 1/66

(52) U.S. Cl. ..... 294/81.6; 294/63.1; 294/87.1; 294/89

(58) Field of Search ..... 294/62, 63.1, 65, 294/67.1, 81.1, 81.3–81.5, 81.6–81.62, 87.1, 89, 92–95, 97; 52/125.1–125.6

(56) References Cited

U.S. PATENT DOCUMENTS

| | | | | | |
|---|---|---|---|---|---|
| 927,180 | A | * | 7/1909 | Simmons | 294/89 X |
| 976,652 | A | * | 11/1910 | Hensley | 294/62 X |
| 1,472,081 | A | * | 10/1923 | Mercer | 294/81.6 |
| 2,794,336 | A | * | 6/1957 | Ballou | 294/89 X |
| 3,180,671 | A | * | 4/1965 | Bachmann | 294/81.61 |
| 3,297,353 | A | * | 1/1967 | Carlson | 294/81.61 |
| 4,088,361 | A | * | 5/1978 | Ditcher | 294/89 |
| 4,474,400 | A | | 10/1984 | Toffolon | 294/97 |
| 4,969,789 | A | * | 11/1990 | Searle | 294/81.61 X |
| 5,490,702 | A | | 2/1996 | Fleming | 294/97 |
| 5,704,675 | A | | 1/1998 | Reiley | 294/95 |
| 5,732,991 | A | * | 3/1998 | Tsui | 294/89 |
| 5,797,638 | A | | 8/1998 | Yamazaki et al. | 294/97 |

FOREIGN PATENT DOCUMENTS

| | | | | |
|---|---|---|---|---|
| DE | 613893 | * | 5/1935 | 294/89 |
| DE | 2043070 | * | 6/1971 | 294/89 |
| DE | 2160575 | * | 6/1973 | 294/89 |

* cited by examiner

*Primary Examiner*—Johnny D. Cherry
(74) *Attorney, Agent, or Firm*—Dean A. Craine

(57) ABSTRACT

A device used to simultaneously lift three concrete blocks from a pallet using a backhoe or crane and reposition them for exact placement on a wall. The device comprises a lifting bar that is suspended in a horizontally aligned position from a cable or chain connected to the shovel or hook on a backhoe or crane, respectively. Extended downward from the lifting bar are three block lifting assemblies. Each block lifting assembly includes two connecting rods that fit into vertically aligned holes formed on the concrete blocks. Each connecting rod is pivotally connected at its upper end to a short segment of chain or cable which pivotally connects to a rigid transfer plate. Each assembly also includes two long segments that pivotally connect to the upper edge of the transfer plate. The upper ends of the two long segments are spaced apart and pivotally connected to the lifting bar so that the long segments converge and are aligned diagonally when the connecting rods are placed inside the holes. Each connecting rod is sufficient in diameter to slide vertically into the hole, yet includes a plurality of optional outer ribs that press against the hole and prevent their removal from the holes when the transfer plate is raised thereby placing lateral force on each connecting rod. When the blocks are properly positioned on the wall, the lift bar is lowered so that lateral pressure exerted by connecting rods on the sides of the holes is reduced thereby enabling the connecting rods to be easily removed manually therefrom.

12 Claims, 6 Drawing Sheets

SIMPLE MULTIPLE CONCRETE BLOCK LIFTING DEVICE

This utility patent application is based on a provisional patent application (Ser. No. 60/287,142) filed on Apr. 27, 2001.

BACKGROUND OF THE INVENTION

1. Field of the Invention

This invention pertains to devices used to lift concrete building or retaining wall blocks in position on a wall, and more particularly, to such devices that enable the blocks to be lifted directly from their pallets and easily repositioned for placement on the wall.

2. Description of the Related Art

Lifting devices that are attachable to backhoes to help construction workers more efficiently set heavy concrete blocks in place on building or retaining walls are widely known. These devices eliminate the need for workers to individually lift the concrete blocks off the pallets and position them on the wall, thus saving time, physical energy, and labor cost. Unfortunately, such devices are able to lift and position only one concrete block at a time, which makes wall building a slow, tedious process.

Large quantities of retaining wall blocks are transported from the supplier to the construction site on pallets. Occasionally, the blocks are aligned in layers that are stacked five to six layers high, with the blocks facing the same direction in each layer. Because each block typically weighs up to approximately 120 pounds, heavy equipment, such as a backhoe, is used to individually lift each block from the pallet. Once lifted from the pallet, the block is transported by workers for exact placement on the wall.

In order to expedite the process and reduce labor and equipment rental costs, a simple, inexpensive lifting device is needed that can easily and securely lift a plurality of blocks directly off the pallet for exact placement on the wall. What is also needed is such a lifting device that is relatively inexpensive to manufacture and easy to use.

SUMMARY OF THE INVENTION

It is an object of the present invention to provide a simple, relatively inexpensive, device that easily and securely lifts a plurality of concrete blocks using common construction lifting equipment, such as a backhoe.

It is another object of the present invention to provide such a device that lifts the concrete blocks in the original positions from a shipping pallet for immediate placement on the wall.

These and other objects of the invention which will become apparent are met by the lifting device disclosed herein designed to be used with a backhoe or crane to lift a plurality of blocks and then align them for exact placement on a wall. The device comprises a lifting bar that is suspended in a horizontally aligned position from a main cable or chain connected at its opposite end to the shovel or hook on a backhoe or crane. Extended downward from the lifting bar is at least one block lifting assembly designed to selectively attach to at least one of the vertically aligned holes formed on the block.

In the preferred embodiment, each block lifting assembly includes two long segments of chains or cables spaced apart and pivotally connected to the lifting bar. The lower ends of the long segments are spaced apart and pivotally connected to the upper corners of a rigid transfer plate. The upper ends of the long segments are sufficiently spaced apart on the lifting bar and the long segments are sufficient in length so that the transfer plate is aligned centrally over a block located on a pallet. Pivotally attached to the opposite lower corners of the transfer plate are two short segments of chains or cables. Pivotally attached to the opposite, lower end of each short segment is an elongated connecting rod. Each connecting rod is sufficient in diameter to slide into the vertically aligned hole formed on the block. In the preferred embodiment each connecting rod includes a plurality of outer ribs that press against the sides of the hole when the connecting rod is forced laterally to prevent its removal from the hole when the lifting bar is initially raised to lift the blocks. When the blocks are properly positioned on the wall, the lift bar is lowered so that the blocks rest on the wall and tension is relieved on the connecting rods so that they may be longitudinally aligned in the holes and able to slide freely to disengage from the hole.

In the preferred embodiment, the lifting device also includes an eye bolt or hook which connects to the main chain or cable attached to a backhoe or forklift that lifts the blocks to the wall.

There has thus been outlined, rather broadly, the more important features of the invention in order that the detailed description thereof that follows may be better understood, and in order that the present contribution to the art may be better appreciated. It should be understood, for example, that the two long segments could be replaced with one long segment centrally connected to the transfer plate. Also, the number of lifting assemblies attached to the lift bar is only limited by the length of the lift bar and the number of blocks on the pallet. There are additional features of the invention that will be described hereinafter and which will form the subject matter of the claims appended hereto.

DESCRIPTION OF THE PREFERRED EMBODIMENT(S)

Figure 1:
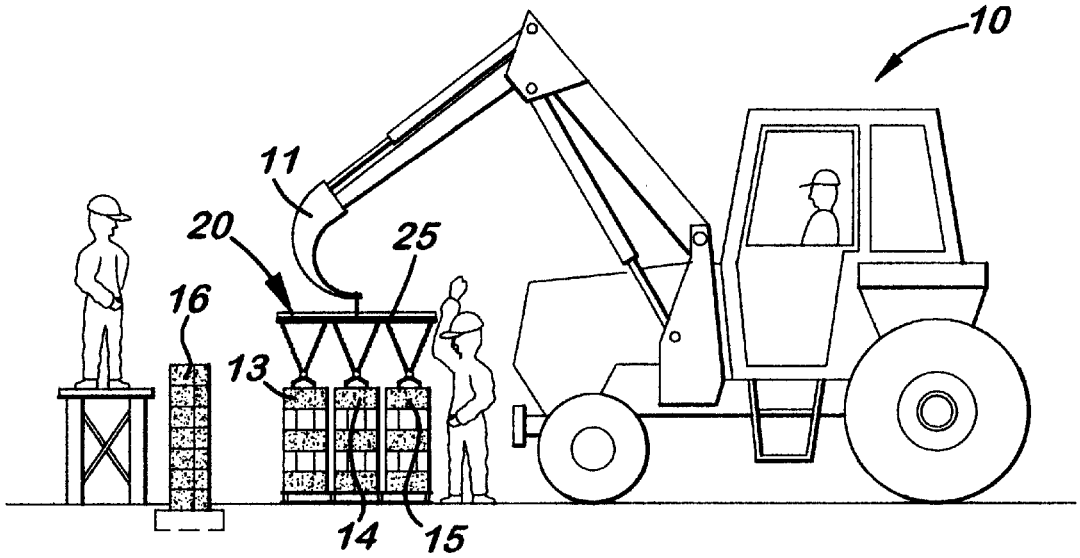
FIG. 1 is a side elevational view of workers using the lifting device to attach to a backhoe and used to lift a plurality of blocks off a pallet.
Figure 2:
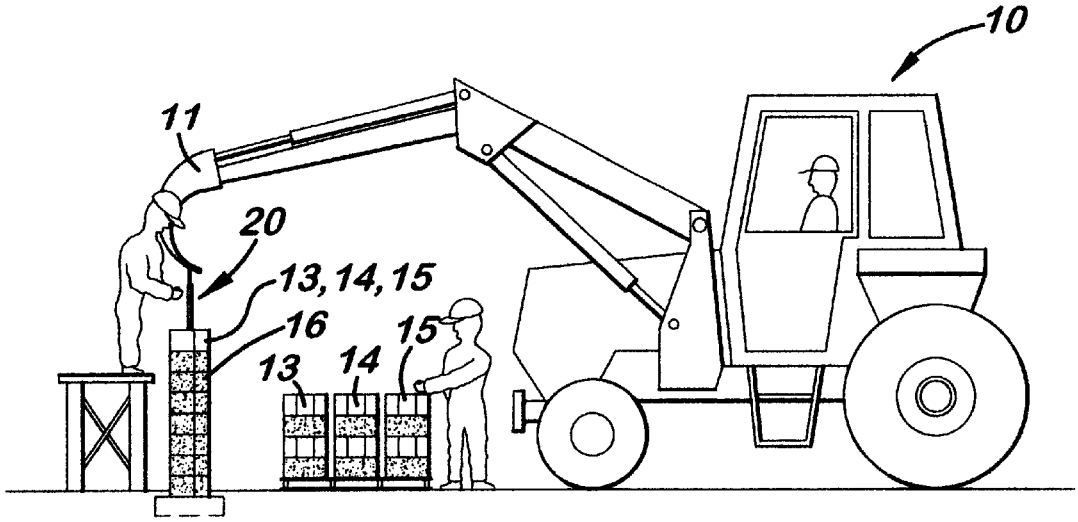
FIG. 2 is a side elevational view similar to FIG. 1 showing the lifting device being used to lift the blocks to the wall.
Figure 3:
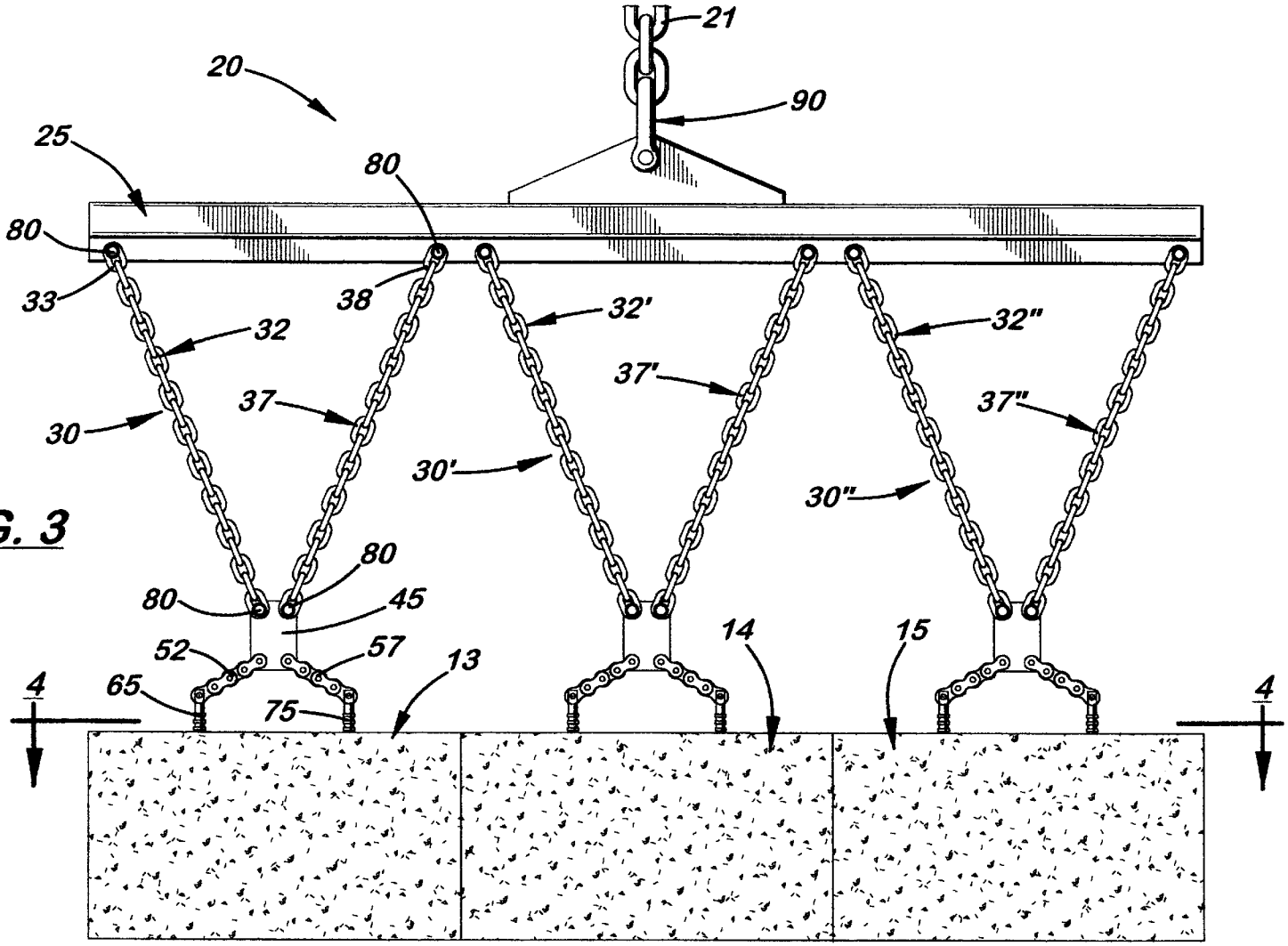
FIG. 3 is a front elevational view of the invention showing the lifting device being used with three longitudinally aligned blocks.

A lifting device 20 is disclosed herein designed to be used with a backhoe 10 or crane to lift a plurality of blocks 13, 14, 15 positioned in a side-by-side manner and facing the same direction for precise placement on a wall 16. The device 20 comprises a horizontally aligned lifting bar 25 that is suspended in a horizontally aligned position from a cable or chain 21 connected at one end to the shovel 11 or bucket on a backhoe 10 or crane. Extended downward from the lifting bar 25 is at least one block lifting assembly 30.

In the preferred embodiment, each block lifting assembly 30 includes two long chain or long cable segments 32, 37, a rigid transfer plate 45, two short chain segments 52, 57, and two elongated connecting rods 65, 75. The upper ends 33, 38 of the long chain segments 32, 37, respectively, are spaced apart approximately the same distance as the width of a lower block 13 and pivotally connected to the lifting bar 25. The long chain segments 32, 37 extend downward from the lifting bar 25 and are diagonally aligned and converge over the center axis of the lower block 13. The pair of long chain segments 32', 37', 32", 37" used to lift adjacent blocks 14, 15, respectively, are also sufficiently spaced apart on the lifting bar 25 so that they are aligned over the center axis of the adjacent blocks 14 or 15.

Figure 4:
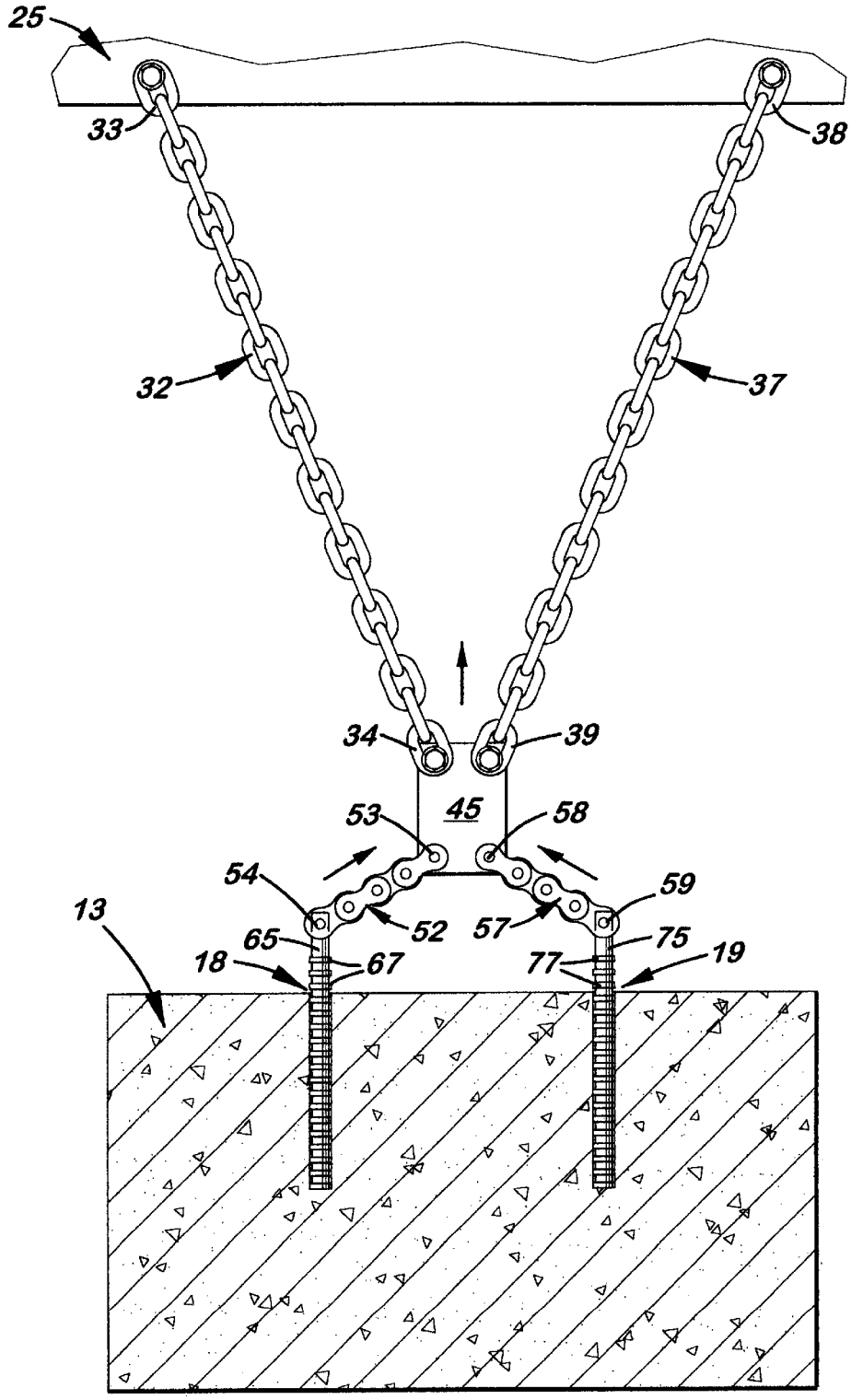
FIG. 4 is a front elevational view of the lifting device initially connected to a block.
Figure 5:
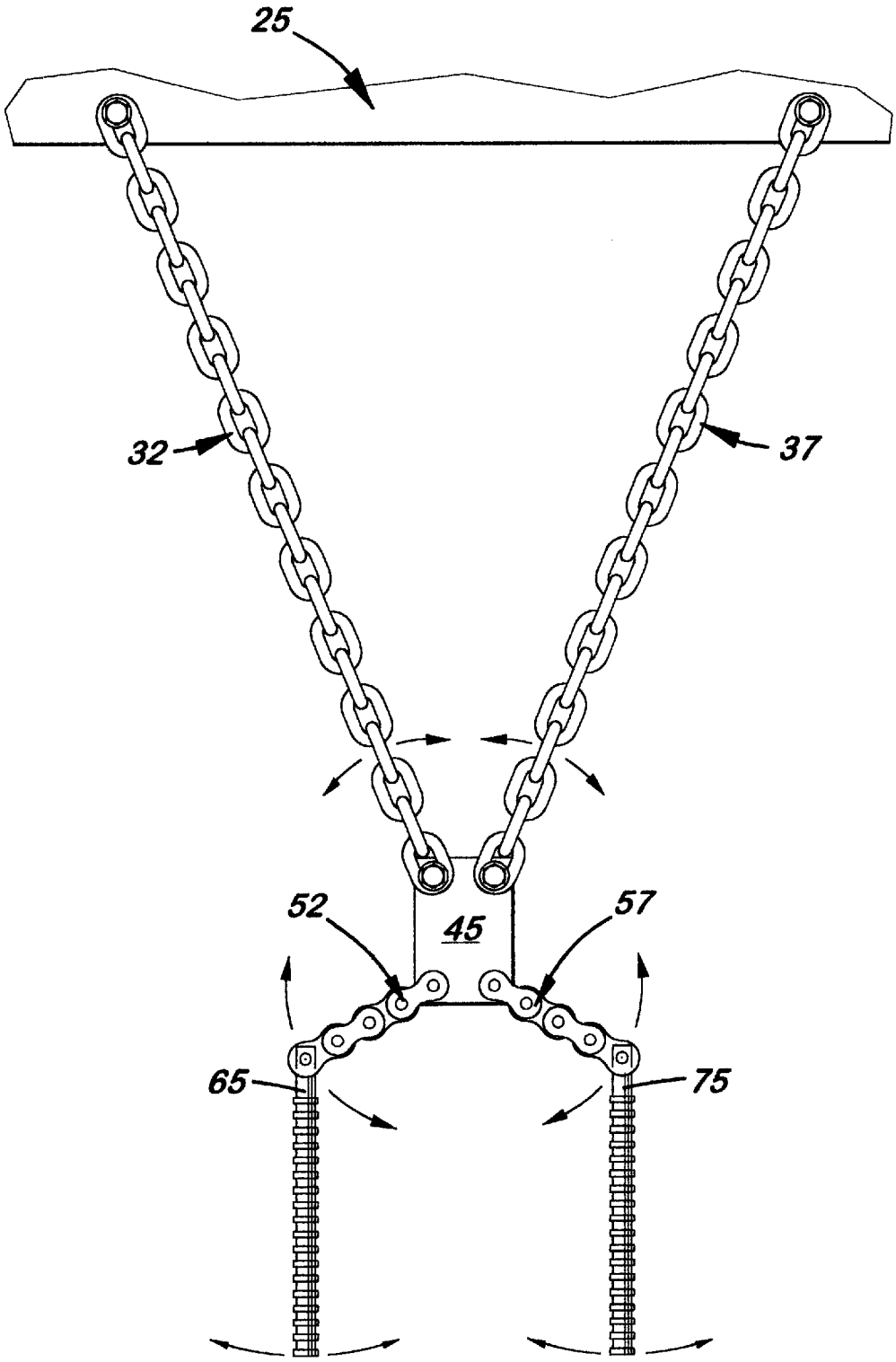
FIG. 5 is a front elevational view of the lifting device showing the movement of the long and short segments and connecting rods when the lift bar is lifted upward.
Figure 6:
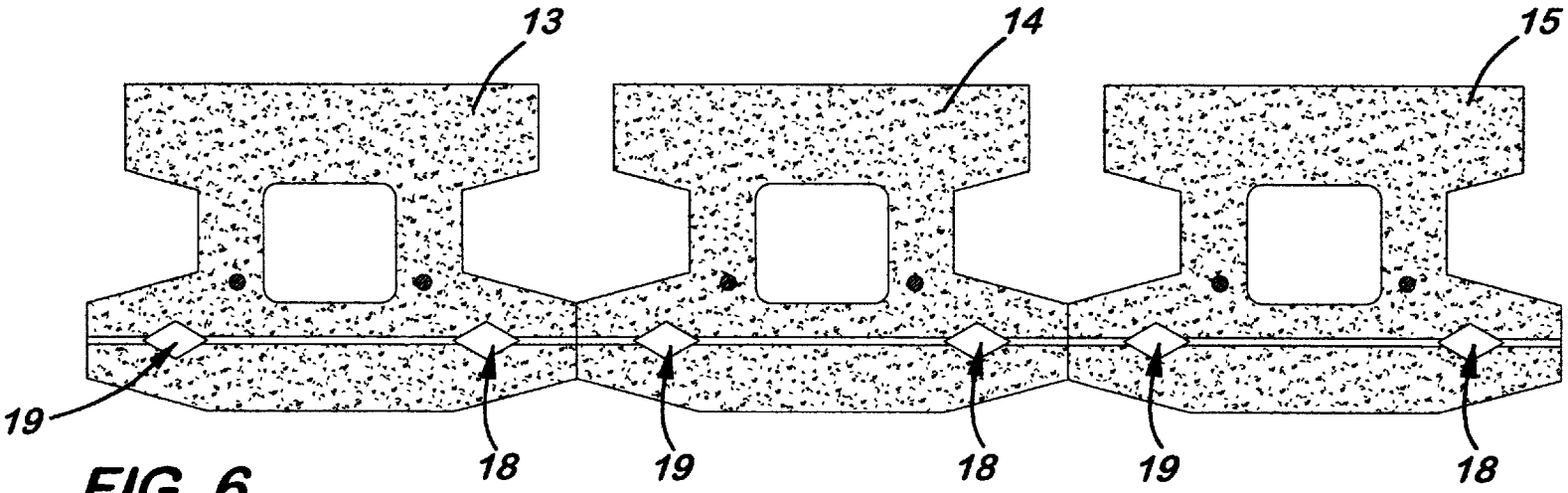
FIG. 6 is a top plan view of three blocks positioned side-by-side on a pallet.

As shown in FIG. 4, the lower ends 34, 39 of the long chain segments 32, 37, respectively, are evenly spaced apart around the center axis of a rigid transfer plate 45 and pivotally attached to the upper corners. The upper ends 53, 58 of the two short chain segments 52, 57, respectively, are evenly spaced apart around the center axis of the transfer plate 45 and pivotally attached to the opposite lower corners. The lower ends 54, 59 of the two short chain segments 52, 57, respectively, are pivotally attached to the upper ends of two connecting rods 65, 75.

Figure 7:
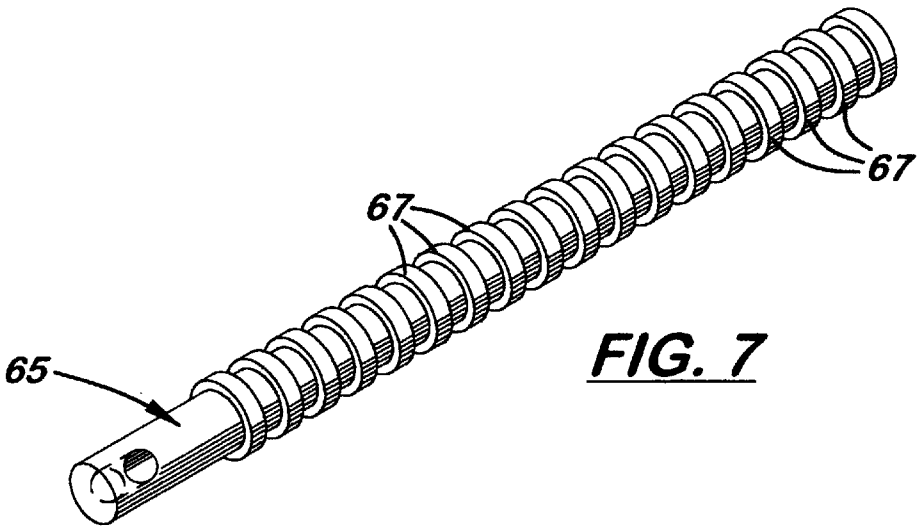
FIG. 7 is a perspective view of a connecting rod.

Each connecting rod 65 or 75 is sufficient in diameter to slide freely into one of the vertically aligned holes 18, 19 formed on a standard block 13. As shown more clearly in FIG. 7, each connecting rod (rod 65 shown) includes a plurality of outer ribs 67, 77 that press against the sides of the holes 18, 19 and prevent removal of the connecting rod 65 therefrom when the lifting bar 25 is raised. When an upward force is applied to the transfer plate 45, the upper end of each connecting rod 65 or 75 is forced inward thereby pressing the outer rib 67, 77 against the sides of the holes 18, 19. When the block 13 is properly positioned on the wall 16, the lifting bar 25 is lowered and upward force is removed thereby enabling the pair of connecting rods 65, 75 to be longitudinally aligned in the holes 18, 19. When the lifting bar 25 is then lifted, the rods 65, 75 are manually held in a vertical alignment so that they do not press against the sides of the holes 18, 19.

In the preferred embodiment, there are three lift assemblies 30, 30', 30" attached to the lifting bar 25. The lifting bar 25 is made of 2×2 inch steel tubing, approximately 48 inches in length. Suitable bolts 80 and nuts (not shown) are used to attach the upper ends 33, 38 of the long segments, 32, 37 to the lifting bar 25. In the preferred embodiment, the upper ends 33, 38, when connected to the lifting bar 25, are approximately 15 inches apart. The length of each long segment 32, 37 is approximately 18 inches.

In the preferred embodiment, the rigid transfer plate 45 is made of steel, measuring approximately 3 inches in length, 2 inches in width, and ¼ inch in thickness. Suitable bolts 80 and nuts (not shown) are used to attach the lower ends 39, 42 of the long chain segments 32, 37 to the transfer plate 45.

In the preferred embodiment, the short chain segments 52, 57 are approximately three inches in length. The top link on each short chain segment 52, 57 is pivotally connected to the lower edge of the rigid transfer plate 45. The bottom link on each short chain segment 52, 57 is pivotally attached to the tip of the connecting rod 65 or 75.

In the preferred embodiment, the connecting rods 65, 75 are approximately ¼ inch in diameter and 6 inches in length. The outer ribs 67, 77 are approximately ½ inch in diameter.

In the preferred embodiment, the lifting device 20 also includes an eye bolt 90 which connects to a main cable 21 or chain attached to the shovel 11 which is used to lift the lifting device 20 and position the blocks 13, 14, 15 on the wall 16.

Figure 8:
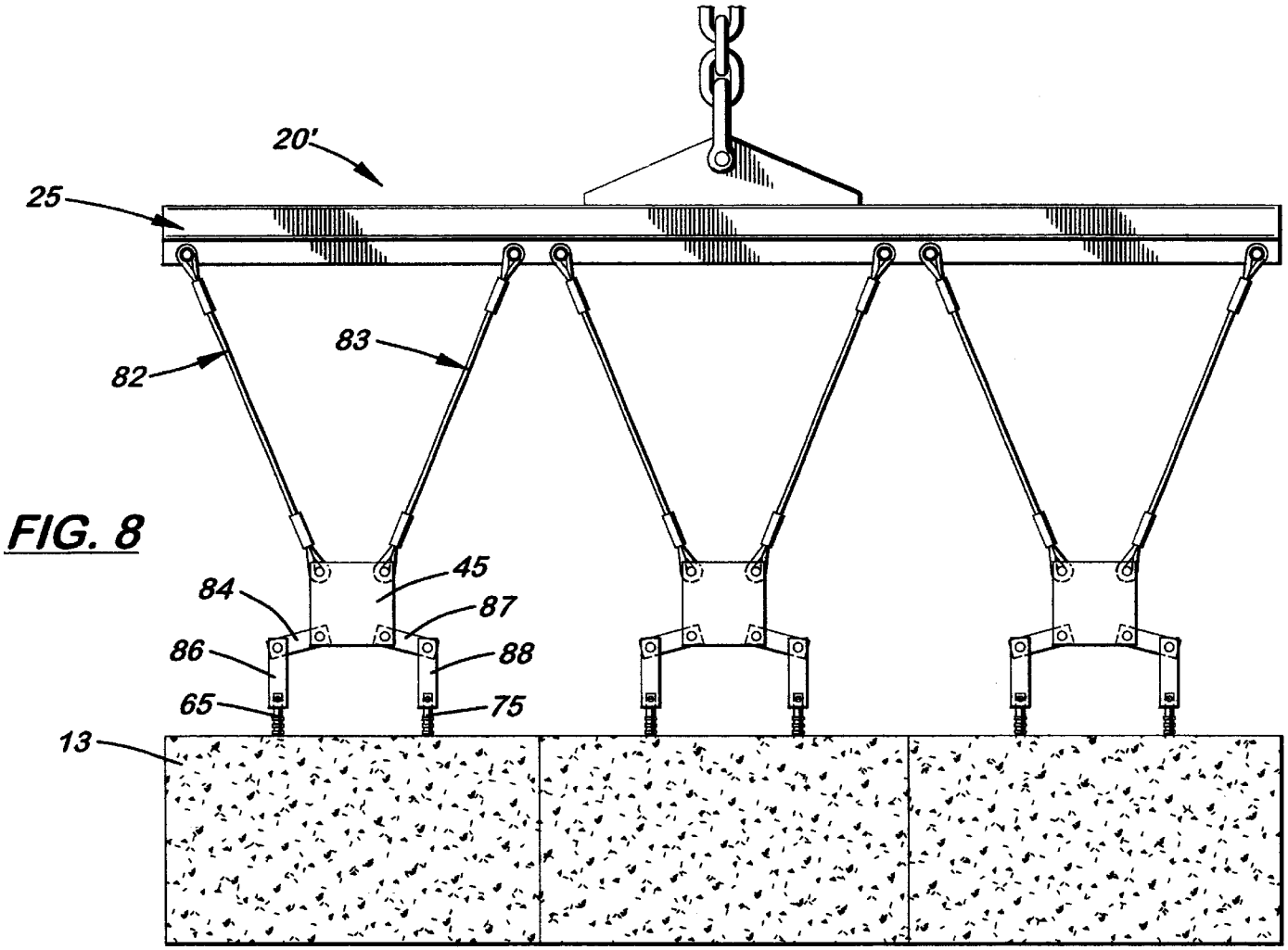
FIG. 8 is a side elevational view of a second embodiment of the lifting device.

FIG. 8 shows a second embodiment of the lifting device 20' wherein the two long chain segments 32, 37 are replaced with long cable segments 82, 83 and the two short chain segments 52, 57 are each replaced with two pairs of articulating leg members 84, 86, and 87, 88. The upper and lower ends of the long cable segments 82, 83 are attached to the lifting bar 25 and rigid transfer plate 45, respectively. The upper end of the leg members 84, 87 is pivotally attached to the lower end of the rigid transfer plate 45. The lower end of the first leg 84, 87 is pivotally attached to the upper end of the second leg member 86, 88, respectively.

It should be understood that the lifting device 20 or 20' could include one lift assembly 30 centrally located and attached to a lifting bar 25. It should also be appreciated that the two long chain or cable segments 32, 37 and 82, 83 could be replaced with one long segment (not shown) centrally attached to the transfer plate 45.

In compliance with the statute, the invention described herein has been described in language more or less specific as to structural features. It should be understood, however, that the invention is not limited to the specific features shown, since the means and construction shown, are comprised only of the preferred embodiments for putting the invention into effect. The invention is therefore claimed in any of its forms or modifications within the legitimate and valid scope of the amended claims, appropriately interpreted in accordance with the doctrine of equivalents.

Further, the purpose of the foregoing abstract is to enable the U.S. Patent and Trademark Office personnel, patent bar practitioners, and the general public, to determine quickly from a cursory inspection the nature and essence of the technical disclosure of the application. The Abstract is neither intended to define the invention of the Application, which is measured by the claim, nor is it intended to be limiting as the scope of the invention in any way.

We claim:

1. A block lifting device for lifting blocks having two vertically aligned holes formed therein, comprising:

a. a lifting bar;

b. at least one block lifting assembly, said block lifting assembly including two long segments, a transfer plate, two short connecting segments, and two connecting rods, said long segments being spaced apart and pivotally attached at an upper end to said lifting bar and pivotally attached at a lower end to said transfer plate, each said short connecting segment being pivotally attached at an upper end to said transfer plate and pivotally attached at a lower end to one said connecting rod, each said connecting rod including a plurality of gripping elements that grip the sides of a hole when said connecting rod is disposed therein and said lifting bar is lifted upward; and, c. means to connect said lifting bar to lifting equipment.

2. The block lifting device as recited in claim 1, wherein said means to connect said lifting bar is an eye bolt connected to a chain.

3. The block lifting device as recited in claim 1, wherein said means to connect said lifting bar is an eye bolt and a lifting cable.

4. The block lifting device, as recited in claim 1, wherein there are three block lifting assemblies evenly spaced apart and attached to said lifting bar.

5. The block lifting device as recited in claim 1, wherein said means to connect said lifting bar is an eye bolt connected to a chain.

6. The block lifting device as recited in claim 1, wherein said means to connect said lifting bar is an eye bolt and a lifting cable.

7. A block lifting device for lifting blocks having two vertically aligned holes formed therein, comprising:

a. a lifting bar;

b. at least two long segments including an upper end and a lower end, said two long segments being spaced apart and pivotally attached at said upper end to said lifting bar;

c. a transfer plate pivotally connected to said lower end of each said long segment;

d. two short segments including an upper end and a lower end, said upper end being pivotally connected to said transfer plate;

e. a connecting rod pivotally attached to said upper end of each said short segment; and, f. means to lift said lifting bar.

8. The block lifting device, as recited in claim 7, further including a plurality of outer ribs formed on each said connecting rod.

9. The block lifting device, as recited in claim 7, wherein said long segments are made of chain.

10. The block lifting device, as recited in claim 7, wherein said short segments are made of chain.

11. The block lifting device, as recited in claim 7, wherein said long segments are made of cable.

12. The block lifting device, as recited in claim 7, wherein each said short segment is made up of two longitudinally aligned and pivotally connected leg members.

* * * * *